US005185491A

United States Patent [19]

Izumisawa et al.

[11] Patent Number: 5,185,491

[45] Date of Patent: Feb. 9, 1993

[54] METHOD FOR PROCESSING A WAVEFORM

[75] Inventors: Gen Izumisawa; Yasushi Sato, both of Hamamatsu, Japan

[73] Assignee: Kabushiki Kaisha Kawai Gakki Seisakusho, Hamamatsu, Japan

[21] Appl. No.: 713,192

[22] Filed: Jun. 10, 1991

[30] Foreign Application Priority Data

Jul. 31, 1990 [JP] Japan ..... 2-201356

[51] Int. Cl.[5] ..... G10H 1/057

[52] U.S. Cl. ..... 84/627; 84/663

[58] Field of Search ..... 84/602-607, 84/627, 663

[56] References Cited

U.S. PATENT DOCUMENTS 4,635,520 1/1987 Mitsumi ..... 84/627 X 4,916,996 4/1990 Suzuki et al. ..... 84/627 X

*Primary Examiner*—Stanley J. Witkowski

*Attorney, Agent, or Firm*—Joseph C. Mason, Jr.; Ronald E. Smith

[57] ABSTRACT

A method for processing a waveform includes the steps of dividing an original musical tone into head data, mix data, and loop data. The data is subjected to several processing steps, including cross-fade mixing. All processing steps are carried out before the processed waveform is stored in memory. Therefore, when the stored data is read out to reproduce the original musical tone, no interpolation steps are required to link the head, mix, and loop data together because that data has been smoothly linked together prior to storage in the memory. As each musical tone is read out, the head data is read out first, followed by the mix data, and then the loop data is read out in alternating directions. The smoothly linked head, mix, and loop portions of the musical tone provide a pleasing reproduction of the original musical tone.

14 Claims, 8 Drawing Sheets

METHOD FOR PROCESSING A WAVEFORM

BACKGROUND OF THE INVENTION

1. Field of the Invention

The present invention relates to a tone generating apparatus and method for use in electronic musical instruments, such as a synthesizer, an electronic piano, an electronic organ and a single keyboard. More particularly, this invention pertains to a tone generating apparatus which repeatedly reads out tone wave data efficiently stored in a wave memory to thereby generate the associated musical tone.

2. Description of the Prior Art

Recently, development of acoustic instruments, such as a piano and an organ, into electronic instruments has become active, providing electronic musical instruments, such as an electronic piano and electronic organ. In addition, a synthesizer which generates tones with a unique timbre is realized as an electronic musical instrument.

These electronic musical instruments have a tone generating apparatus (tone generator) with an incorporated wave memory in which tone wave data is stored. The wave memory has multiple groups of tone wave data stored in association with respective timbres to permit generation of various timbres. One group of tone wave data consists of multiple pieces of tone wave data to generate a predetermined tone waveform.

In such a tone generating apparatus, when a predetermined timbre is specified operating a panel switch, for example, one group of tone wave data is selected from the multiple groups of tone wave data stored in the wave memory. Each tone wave data constituting the selected group is read out at a speed corresponding to the pitch specified by a key. The read-out tone wave data is reproduced into a tone waveform by a waveform generator, and it is output as a tone wave signal to an acoustic circuit. Upon reception of this tone wave signal, the acoustic circuit drives loudspeakers, a headphone or the like in accordance with the tone wave signal, thereby releasing a musical tone.

Because of the limited capacity of the wave memory, the conventional tone generating apparatus employs the art of compressing tone wave data before storing it in the wave memory.

For instance, a group of tone wave data of a musical tone having a certain timbre is generated as follows.

First, pulse code modulated (PCM) wave data which is to be original wave data (original data) is prepared. Then, two pieces of data with a predetermined length are consecutively extracted from the original data at an arbitrary position, the first half portion subjected to fade-in processing and the second half portion subjected to fade-out processing.

Next, the wave data having undergone the fade-in processing is mixed with the data having undergone the fade-out processing by performing an arithmetic operation (which is called "cross-fade mixing"). The cross-fade-mixed data serves as loop data which is to be repeatedly read out.

Then, data extending from the head of the original data to the middle of the extracted pieces of data is linked with the loop data to acquire a group of tone wave data for a certain timbre. The tone wave data group thus produced is stored in a wave memory.

The tone wave data group stored in the wave memory is first read out once from the head to the last portion to release the associated musical tone. Thereafter, only the loop data portion will repeatedly be read out to release the associated musical tone.

With the above arrangement, the tone generating apparatus can reproduce, with high fidelity, a complex and delicate sound included in the attack portion of a musical tone and can generate a musical tone of the sustaining portion with fewer pieces of tone wave data, thus ensuring data compression. Further, the execution of cross-fade mixing smooths where the attack portion of the musical tone and the repetitive-reading portion are linked, and smooths the link between the consecutive repetitive-reading portions as well.

However, the data of the attack portion of a musical tone consisting of a group of tone wave data prepared by the above method should at least amount to the aforementioned predetermined length (equal to the length of loop data) or greater. Preparation of tone wave data groups in accordance with various timbres, tone ranges, etc., therefore, would result in a vast amount of data.

In addition, it is necessary to provide a certain amount of tone wave data of the repetitive-reading portion (loop data) to avoid a cyclic uncomfortable sound which may result from an insufficient amount of tone wave data.

The conventional method of preparing, storing or reproducing a group of tone wave data requires a large-capacity wave memory, inevitably increasing the cost of the tone generating apparatus.

SUMMARY OF THE INVENTION

It is therefore an object of the present invention to provide a tone generating apparatus and method which can employ a smaller-capacity wave memory and can therefore be manufactured at a low cost.

To achieve this object, according to the present invention, there is provided a tone generating apparatus comprising a wave memory for storing tone wave data consisting of head data extracted by an arbitrary length from an attack portion of an original musical tone, loop data acquired by extracting a sustaining portion of the original musical tone by a given length and subjecting the extracted sustaining portion to predetermined processing and mix data with a given length including individual waveform elements of the head data and the loop data and linking the head data and the loop data; reading means for reading out the tone wave data from the wave memory in the following order: 1) head data, 2) mix data, and 3) repeatedly reading out the loop data; and tone generating means for generating a musical tone based on the tone wave data read out by the reading means.

With the above structure, the novel method is performed, i.e., at the time tone wave data is stored in the wave memory, an arbitrary length of data is extracted from the attack portion of an original musical tone to prepare head data, the sustaining portion of the original musical tone is extracted by a given length and is subjected to predetermined processing, such as cross-fade mixing, to provide loop data, then the head data and loop data are subjected to, for example, cross-fade mixing with a given length, to provide mix data which thus includes individual waveform elements of the head data and loop data and links these two pieces of data, and the head data, mix data and loop data are stored in the wave memory in the named order. At the time the tone wave data is read out from the wave memory, the head data and mix data are consecutively read out first, then the loop data is read out, and thereafter, the loop data is repeatedly read out to thereby generate a sustaining sound. As the head data and mix data can be set to any length, therefore, the amount of these data can be reduced to the minimum.

If the loop data which represents the repetitive-reading interval is read out in alternate increasing and decreasing directions, the amount of the loop data can be reduced to a half of what is required when it is read out in one direction. This can further compress the amount of tone wave data.

DETAILED DESCRIPTION OF THE PREFERRED EMBODIMENTS

Figure 2:
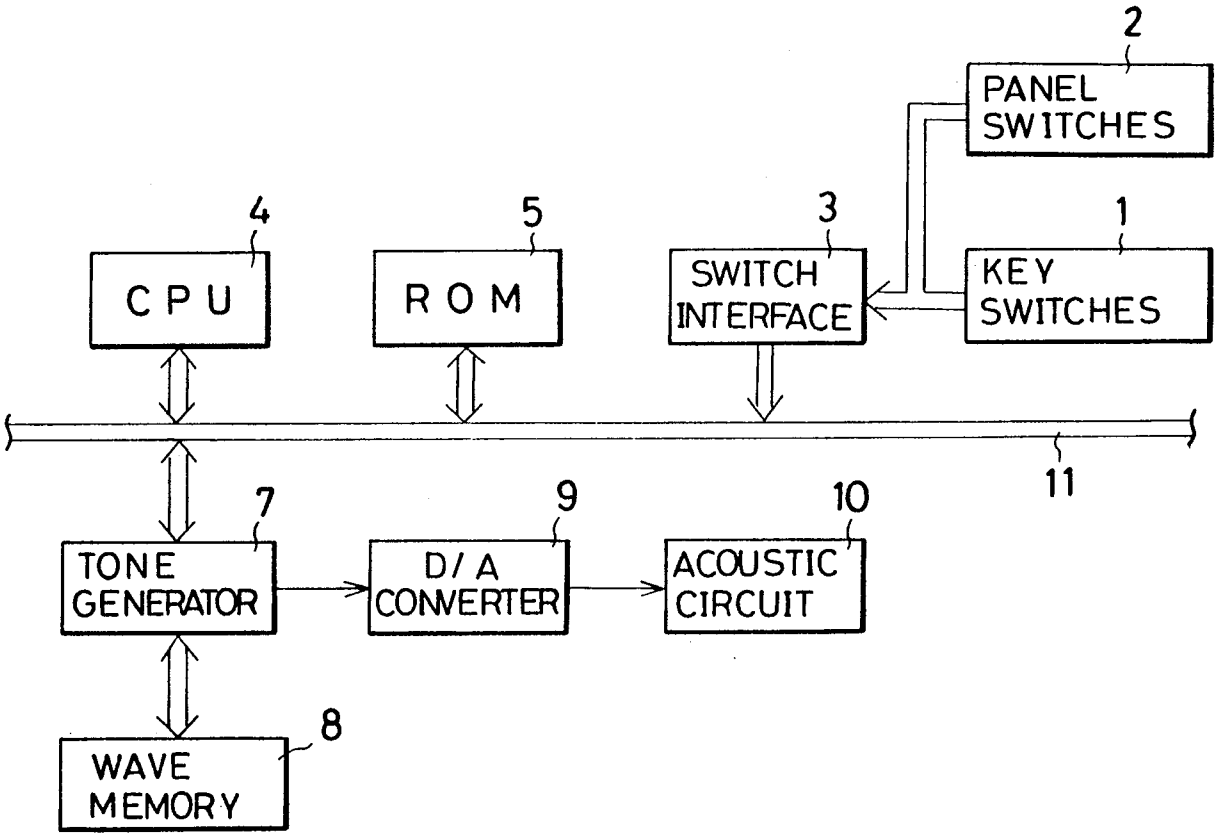
FIG. 2 is a schematic block diagram illustrating the general structure of an electronic musical instrument to which the tone generating apparatus of the present invention is applied.

FIG. 2 is a schematic block diagram illustrating the general structure of an electronic musical instrument to which the tone generating apparatus and method of the present invention is applied.

Referring to this diagram, key switches 1 detect whether a player has pressed or released a key, and inform a central processing unit (CPU) 4 of that information. The key switches 1 include multiple keys and a key scan circuit for detecting the depression status of each key. Signals from the key switches 1 are sent to a switch interface 3.

Panel switches 2 include a power switch, a mode designate switch, a melody select switch, a rhythm select switch, etc. The set/reset status of each panel switch is detected by a panel scan circuit included in the panel switches like the key scan circuit in the key switches 1. Signals from the panel switches 2 are also sent to the switch interface 3.

The switch interface 3 outputs data concerning the statuses of the key switches 1 and the panel switches 2, i.e., data for the panel switches in the ON status, a key code and touch data for a key newly depressed, and a key code for a key newly released. The touch data is generated by a well-known touch detector (not shown).

The CPU 4 controls each section of the electronic musical instrument in accordance with a control program which is stored in a program memory section in a read only memory (ROM) 5.

The ROM 5 has a control program for operating the CPU 4 and various fixed data, such as timbre data.

A tone generator 7, directly relating to the feature of the present invention, is connected to a wave memory 8. The tone generator 7 and the wave memory 8 will be described in detail later. A digital tone signal from the tone generator 7 is sent to a D/A converter 9.

The switch interface 3, the CPU 4, the ROM 5 and the tone generator 7 are connected to one another by a system bus 11.

The D/A converter 9 converts a received digital tone signal to an analog signal. The analog signal from the D/A converter 9 is supplied to an acoustic circuit 10.

The acoustic circuit 10 converts the received analog electric signal into an acoustic signal; this function is realized by, for instance, loudspeakers or a headphone.

Figure 3:
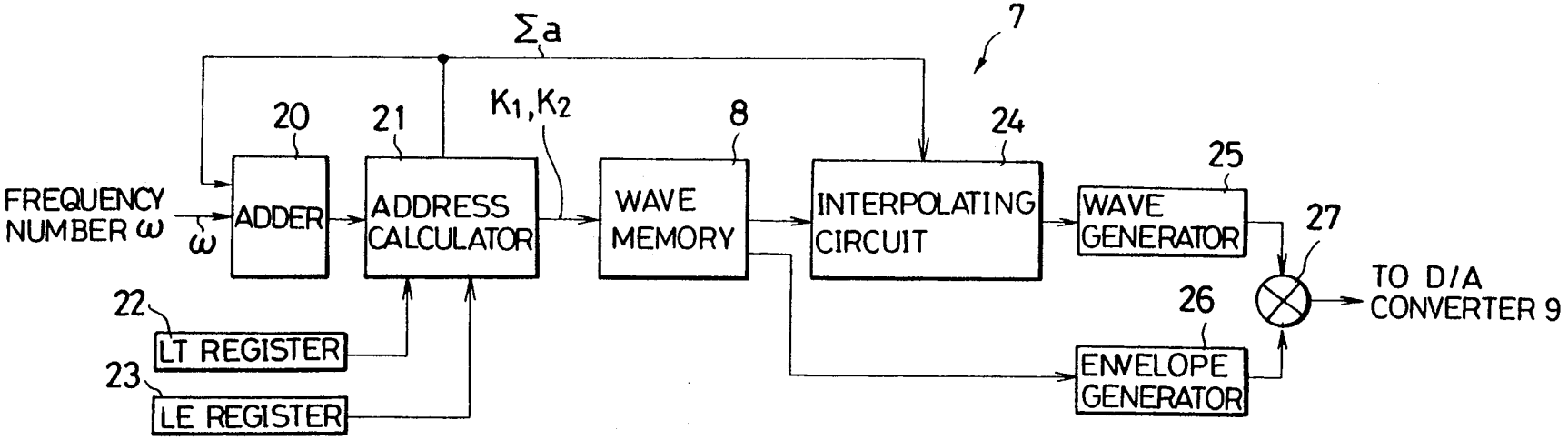
FIG. 3 is a detailed block diagram illustrating a wave memory and a tone generator according to the embodiment of the tone generating apparatus of the present invention.

FIG. 3 is a block diagram illustrating the tone generator 7 and the wave memory 8 in the electronic musical instrument in detail.

To begin with, the structure of the tone generator 7 will be described. It is assumed that the wave memory 8 has envelope data stored therein besides the tone wave data.

An adder 20 adds a current read address $\Sigma a$ stored in an address calculator 21 to a frequency number $\omega$ which is sent from the CPU 4.

The frequency number $\omega$ is data indicating a pitch; more specifically, it is data which designates a sampling interval in the address space of the wave memory 8. This frequency number $\omega$ includes effective numbers below a decimal point.

The result of the addition performed in the adder 20 is supplied again to the address calculator 21 to be stored as the next read address. That is, the adder 20 and the address calculator 21 realize the function of an accumulator.

The address calculator 21 controls the repetitive data reading in accordance with the address values set in an LT (loop top) register 22 and an LE (loop top) register 23 as well as stores the next read address calculated in the adder 20 as described above. Specifically, the address calculator 21 performs various address computations as illustrated in the flowchart shown in FIG. 4 (which will be described later), and is constituted by a wired logic or a processor.

The read address $\Sigma a$ stored in this address calculator 21 is supplied to the adder 20 and an interpolating circuit 24. Further, an integer portion $K_1$ and an integer address $K_2$ for interpolation of the read address $\Sigma a$ computed in the address calculator 21 are supplied to the wave memory 8. The interpolating integer address $K_2$ is the integer portion $K_1$ plus "1".

The interpolating circuit 24 proportionally distributes two pieces of tone wave data, namely, tone wave data read out from the wave memory 8 using the integer portion $K_1$ of the read address and tone wave data read out therefrom using the interpolating integer address $K_2$, in accordance with the fraction portion of the present read address $\Sigma a$, i.e., the circuit 24 performs interpolation of the two pieces of tone wave data. The circuit 24 then supplies the resultant data to a wave generator 25. More specifically, when the calculated read address $\Sigma a$ includes a fraction portion, a value to be data at the read address $\Sigma a$ is computed in accordance with the difference (inclination) between the values stored at two integer portions preceding and following Σa, i.e., the integer portion $K_1$ and interpolating integer portion $K_2$, and this value is supplied as the value of tone wave data to the wave generator 25. The interpolating circuit 24 is constituted by a wired-logic or processor which is designed to realize the above function.

The wave generator 25 reproduces a tone waveform based on the tone wave data from the interpolating circuit 24, and generates a tone wave signal. This tone wave signal is in turn supplied to a multiplier 27.

An envelope generator 26 generates an envelope signal based on envelope data read out from the wave memory 8, and supplies it to the multiplier 27.

The multiplier 27 multiplies the tone wave signal from the wave generator 25 by the envelope signal from the envelope generator 26, thus providing a tone signal having the envelope signal added thereto. This tone signal is converted into an analog signal by the D/A converter 9, which is in turn released from the acoustic circuit 10 (see FIG. 2).

A description will be given below of tone wave data which is stored in the wave memory 8.

Figure 1A:
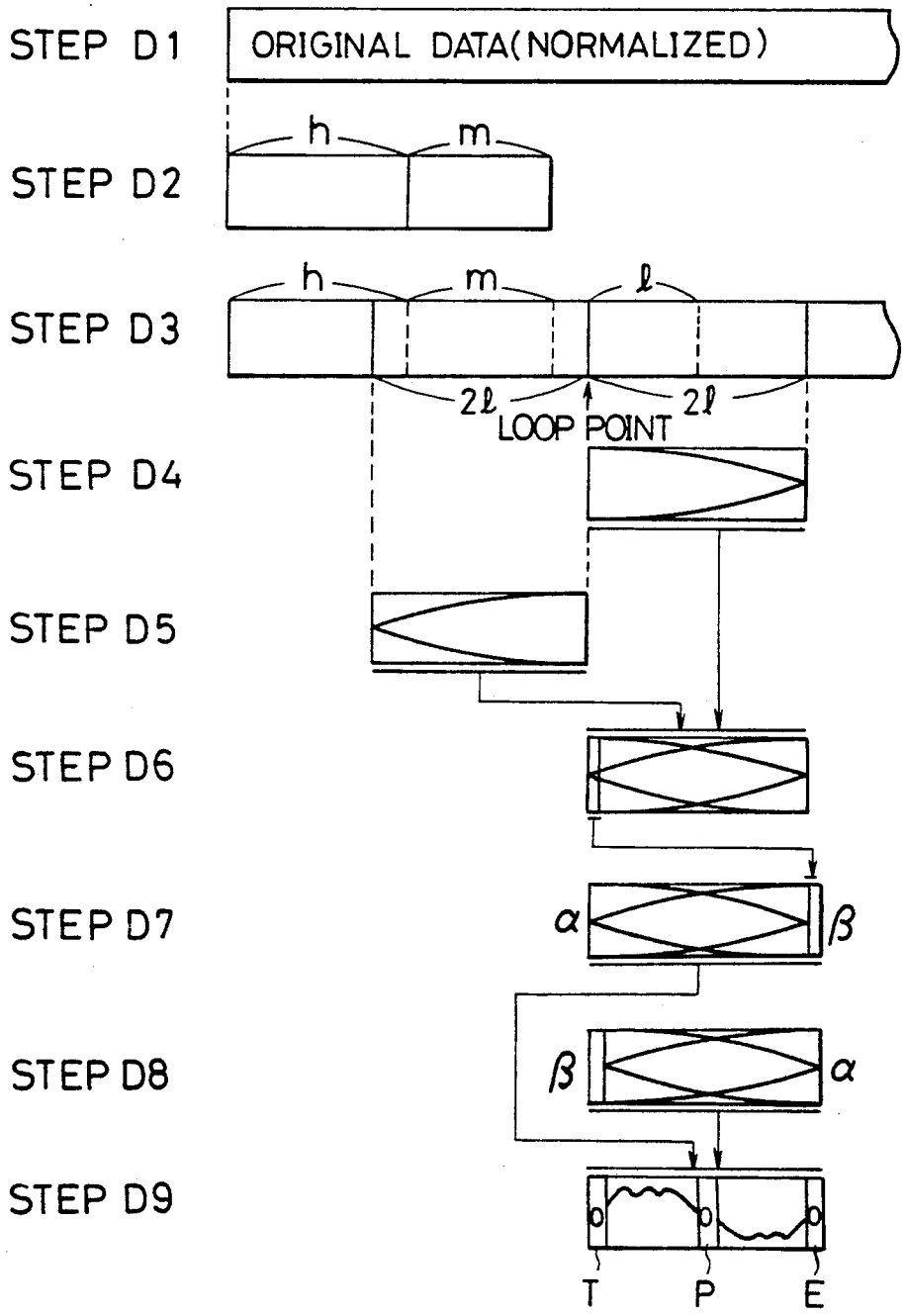
FIG. 1A and 1B are diagrams for explaining how to produce tone wave data to be used in a tone generating apparatus according to one embodiment of the present invention.
Figure 1B:
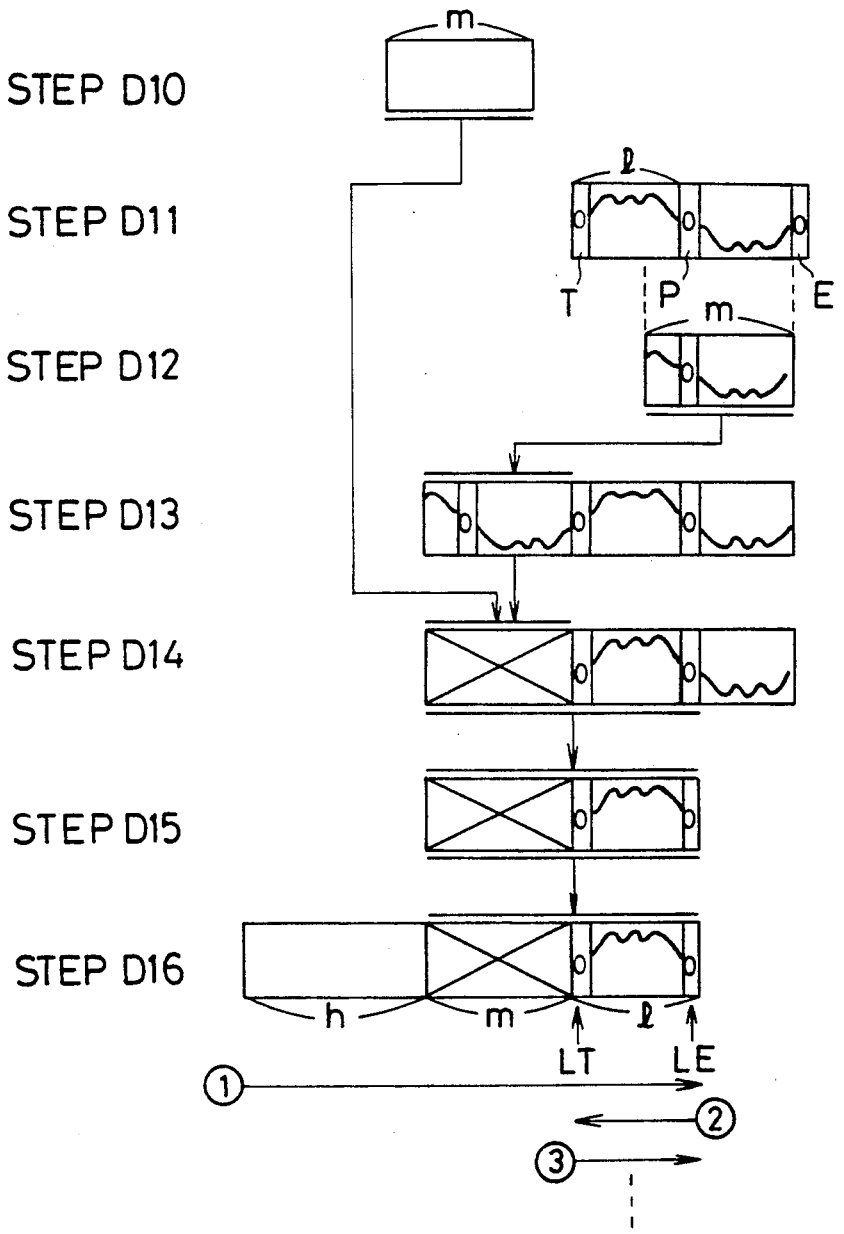

The wave memory 8 stores tone wave data prepared through predetermined procedures. FIGS. 1A and 1B illustrate how to prepare the tone wave data.

First, digital PCM wave data to be original wave data (original data) is prepared (step D1). In this case, for the tone waveform of a diminishing tone, such a piano sound, its envelope is normalized to be converted into a tone waveform with a given amplitude.

With this original data, the width of "data to be the attack portion of a musical tone" serving as the first interval (hereinafter called "head data") and the width of "data to be a link portion" serving as the second interval (hereinafter called "mix data") are determined (step D2). The width of the head data is h words from the head of the original data, while the width of the mix data is m words of the original data following the head data. Here, the "mix data" is data which links the head data to "data to be a repetitive-reading portion" (hereinafter called "loop data"), which will be described later.

The loop data has an arbitrary data width equivalent to l words and is prepared by performing the following processing.

These data widths h and m are arbitrarily selectable. While the data width l of the loop data can of course be determined arbitrarily, it is impractical to set it too short.

Then, any point of the original data is selected as a loop point, and 2l words (even words) are extracted from either side of this loop point (step D3). The second 2l-word portion is weighted to have a fade-out effect (step D4), while the first 2l-word portion is weighted to have a fade-in effect (step D5).

Next, an arithmetic operation, such as addition, is performed on the weighted fade-in data and fade-out data to mix both (step D6). This mixing is called "cross-fade mixing" as mentioned earlier.

Then, the first one word of the cross-fade-mixed data is affixed to the end of that data (step D7), thus making the cross-fade-mixed data to be odd words.

Reverse processing is then executed (step D8). This reverse processing is to read the data from the last one in order to invert the phase so that this data is rearranged to be sequential from the beginning. In other words, this processing converts data arranged in the increasing order from α to β in the diagram while inverting its phase to be rearranged in the increasing order from β to α.

The cross-fade-mixed data acquired in step D7 and the data subjected to the reverse processing in step D8 are added together (step D9). This yields data wherein the first one word T, the last one word E and one word P at the center become zero and which is point-symmetrical with P at the center. Although a single-period waveform is illustrated in FIG. 1A for easy understanding of the point-symmetrical shape, the waveform may have multiple periods.

Then, the m words determined in step D2 are extracted (step D10).

The point-symmetrical wave data acquired in step D9 is fetched (step D11), and the lower m words thereof excluding the last one word E are extracted (step D12). The data of the extracted m words is affixed to the top of the point-symmetrical wave data (step D13). As a result, the affixed data becomes continuous to the original point-symmetrical wave data.

Next, the m words extracted in step D10 are cross-fade-mixed with the m words added in step D13 (step D14). This smooths the linkage between the cross-fade-mixed portion and the point-symmetrical wave data.

Then, of the data acquired in step D14, the lower portion of the point-symmetrical wave data is cut away (step D15).

Finally, the h words determined earlier in step D2 are extracted and are affixed to the top of the data acquired in step D15 (step D16).

Through the above procedures is acquired tone wave data which consists of the attack portion of the musical tone (head data), h words, the repetitive-reading portion (loop data), l words, and the link portion (mix data) to connect the former two portions, m words. This tone wave data is to be stored in the wave memory. Since head data of h words and loop data of l words are connected by mix data of m words, the tones are linked smoothly. Accordingly, no interpolation means are required to link the words together at the time of read-out.

At the time the tone wave data prepared in the above manner and stored in the wave memory 8 is read out therefrom, it is read out while altering the reading direction within the ranges and in the order as indicated by the arrows ①, ②, ③, . . . This generates a sequence of musical tones which smoothly change from the attack status to the sustaining status.

The loop data is defined by a loop top address LT and a loop end address LE, and is stored in a range from LT to "LE−1". The same tone wave data as stored at LT (zero in this case) is stored at LE.

Figure 4A:
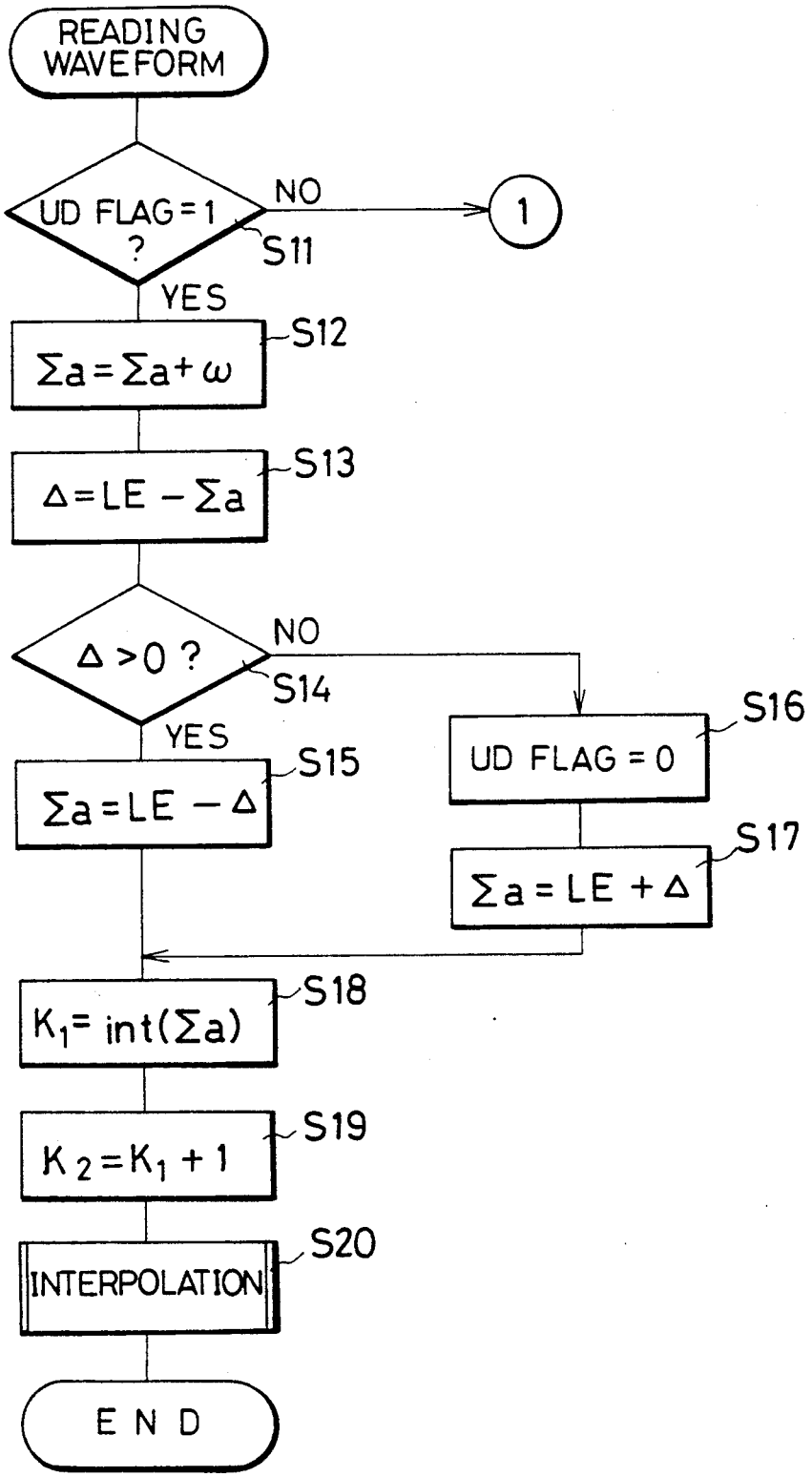
FIGS. 4A and 4B are flowcharts illustrating the operation of the embodiment of the present invention.
Figure 4B:
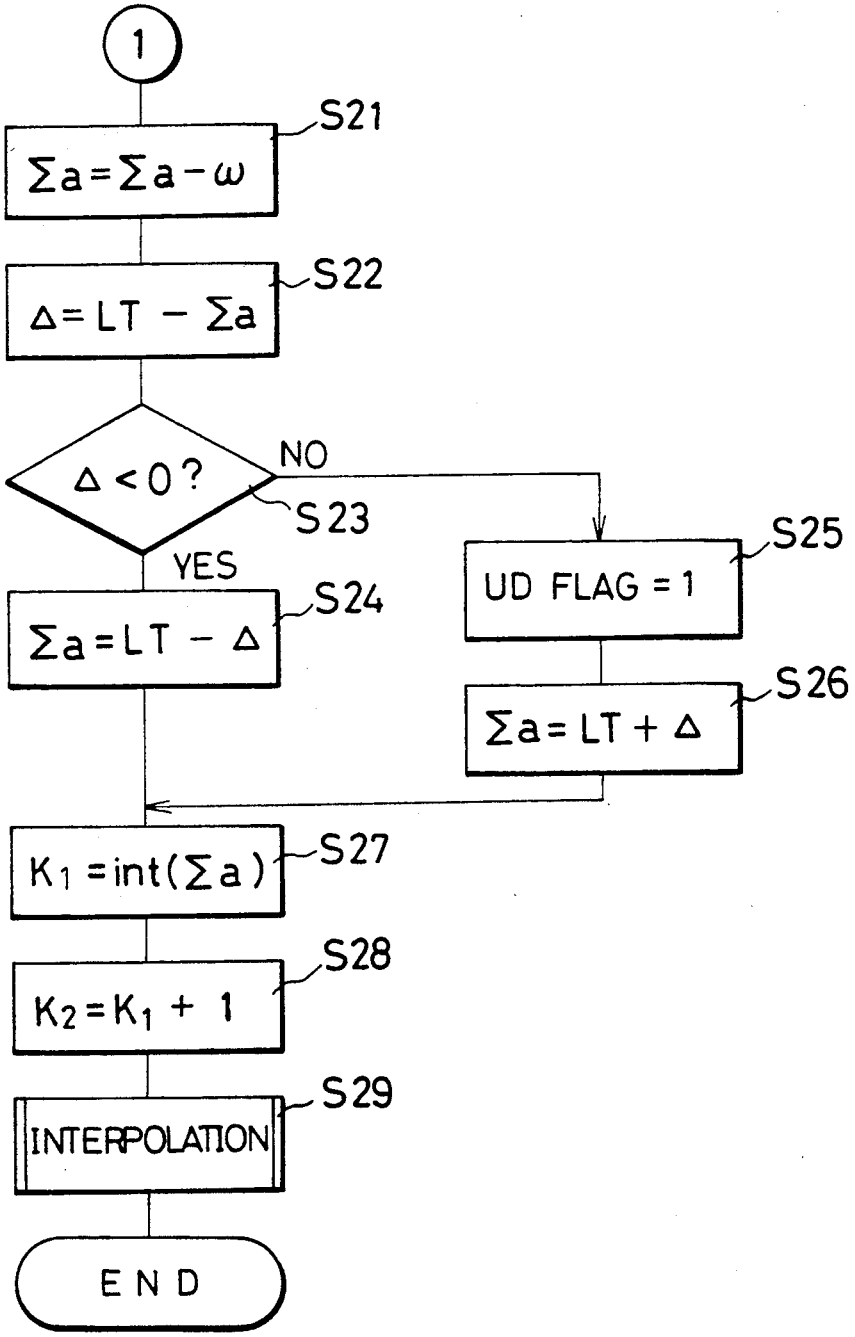

Referring now to the flowcharts shown in FIGS. 4A and 4B, a description will now be given of the operation of the embodiment of the present invention having the above-described structure and employing the described method of storing tone wave data. It is assumed that a UD flag has initially been set to "1."

First, it is checked if the UD flag is "1" (step S11). The UD flag specifies the reading direction: the upward reading or reading from the loop top address LT toward the loop end address LE when it is "1" and downward reading or reading from the loop end address LE toward the loop top address LT when it is "0".

When the UD flag is judged to be "1" in step S11, the upward reading and interpolation as described in steps S12 to S20 start. Note that this interpolation relates to the calculation of values when a read address falls between integer read addresses; this interpolation does not relate to the above-described inventive mixing and smooth linking of data words that is performed prior to storage of tone wave data in the wave memory 8.

First, the frequency number $\omega$ given from the CPU 4 is added to the present read address $\Sigma a$ stored in an internal register (not shown) of the address calculator 21 to calculate the next read address $\Sigma a$ in the adder 20 and the address $\Sigma a$ is stored in the internal register (not shown) of the address calculator 21 (step S12).

Then, the next read address $\Sigma a$ obtained in step S12 is subtracted from the loop end address LE set in the LE register 23 to acquire a difference $\Delta$ (step S13). It is then checked if this difference $\Delta$ is greater than zero (step S14). If the difference $\Delta$ is greater than zero, or if the sampling position does not exceed the loop end address LE, the difference $\Delta$ is subtracted from the loop end address LE to restore the next read address $\Sigma a$ (step S15).

If the difference $\Delta$ is equal to or smaller than zero, or if the sampling position is beyond the loop end address LE, the UD flag is set to "0" to subsequently execute the downward reading and interpolation (step S16).

Then, the difference $\Delta$ is added to the loop end address LE to provide the next read address $\Sigma a$ (step S17). Since the difference $\Delta$ in this case is negative, the next read address $\Sigma a$ will be at the position apart by $\Delta$ toward the loop top address LT from the loop end address LE. This next read address $\Sigma a$ becomes the same as the value acquired by adding the frequency number $\omega$ to the loop end address LE, if it is considered as a multiple-period waveform obtained by linking multiple-period waveforms at point symmetrical positions, i.e., multiple-period waveforms of opposite phases formed by rotating a multiple-period waveform 180 degrees around the loop end LE.

Then, the integer portion of the next read address $\Sigma a$ calculated in the step S15 or S17 is extracted to be an integer portion $K_1$ of the read address (step S18), and "1" is added to this integer portion $K_1$ to be an integer address $K_2$ for interpolation (step S19).

Next, the interpolating circuit 24 performs interpolation using the present read address $\Sigma a$, the integer portion $K_1$ and the integer address $K_2$ (step S20).

At this time, if the present read address $\Sigma a$ lies within the following formula (1), then the interpolation is performed using "LE−1" as the integer portion $K_1$ and "LE" as the integer address $K_2$.

$$Le-1 \leqq \Sigma a \leqq LE \quad (1)$$

When the UD flag is not judged to be "1" in the aforementioned step S11, the downward reading and interpolation as described in steps S21 to S29 starts. First, the frequency number $\omega$ given from the CPU 4 is subtracted from the present read address $\Sigma a$ stored in an internal register (not shown) of the address calculator 21 to calculate the next read address $\Sigma a$ in the adder 20 and the address $\Sigma a$ is stored in the internal register (not shown) of the address calculator 21 (step S21). The read address $\Sigma a$ and frequency number $\omega$ both include fraction portions as described earlier. Then, the next read address $\Sigma a$ obtained in step S21 is subtracted from the loop top address LT set in the LT register 22 to acquire a difference $\Delta$ (step S22). It is then checked if this difference $\Delta$ is smaller than zero (step S23). If the difference $\Delta$ is smaller than zero, or if the sampling position does not exceed the loop top address LT, the difference $\Delta$ is subtracted from the loop top address LT to restore the next read address $\Sigma a$ (step S24). If the difference $\Delta$ is equal to or greater than zero, or if the sampling position is beyond the loop top address LT, the UD flag is set to "1" to subsequently execute the upward reading and interpolation (step S25). Then, the difference $\Delta$ is added to the loop top address LT to provide the next read address $\Sigma a$ (step S26). Since the difference $\Delta$ in this case is positive, the next read address $\Sigma a$ will be at the position apart by $\Delta$ toward the loop end address LE from the loop top address LT. Then, the integer portion of the present read address $\Sigma a$ calculated in step S24 or S26 is extracted to be an integer portion $K_1$ of the read address (step S27), and "1" is added to this integer portion $K_1$ to be an integer address $K_2$ for interpolation (step S28). Next, the interpolating circuit 24 performs interpolation using the present read address $\Sigma a$, the integer portion $K_1$ and the integer address $K_2$ (step S29). At this time, if the present read address $\Sigma a$ lies within the following range $$LT \leqq \Sigma a \leqq LT+1 \quad (2)$$

then the interpolating circuit 24 performs the interpolation using "LT+1" as the integer portion $K_1$ and "LT" as the integer address $K_2$.

In the interpolation in the downward direction, the phase of the tone wave data will be inverted, thus providing the same results as provided in the case where a one-period waveform is continuously generated with the loop end address LE taken as point symmetric.

A description will now be given of another way of producing tone wave data to be stored in the wave memory 8.

Figure 5:
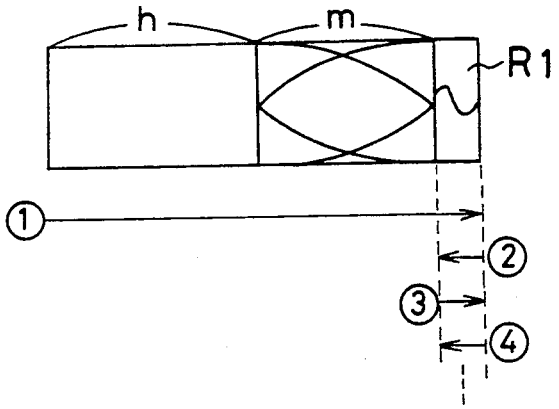
FIG. 5 is a diagram showing different embodiment of tone wave data as used in the tone generating apparatus of the present invention.

FIG. 5 illustrates tone wave data having loop data constituted by a half-period or one-period waveform. For instance, a half-period or one-period waveform R1 acquired by synthesizing waveforms using, for example, reverse Fourier transform, and the waveform of the h words of the attack portion of the original data are linked together with the cross-fade-mixed portion of the m words by the same method as described earlier, thereby producing tone wave data. Reading the resultant data in the order of ①, ②, ③, ④, etc., can generate the same musical tone as described above.

With this arrangement, it is possible to obtain tone wave data which is compressed more than the data in the previous embodiment, permitting the use of a smaller-capacity wave memory.

In addition, the transition from the attack portion to the repetitive portion is smooth.

Figure 6:
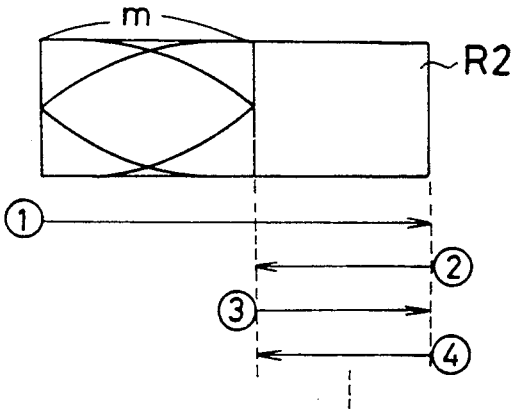
FIG. 6 is a diagram illustrating another embodiment of tone wave data as used in the tone generating apparatus of the present invention.

FIG. 6 exemplifies tone wave data having no head data.

This tone wave data is produced by setting the width h of the head data to zero and determining the width of the mix data as m words from the top in step D2 in FIG. 1 for determining the widths h and m, then executing the processing including and following step D3. At this time, loop data is multiple-period wave data. As the processes in the individual steps are the same as those discussed above, their explanation will be omitted here.

Through the processing is yielded tone wave data which has h words of the attack portion of a musical tone eliminated in step D15 in FIG. 1 and has the mix data linked to the loop data R2 having a multiple-period waveform, as shown in FIG. 6. The cross-fade-mixed portion (mix data) of this tone wave data includes data having m words of the original data from the top subjected to fade-out processing. The tone wave data thus acquired is stored in the wave memory. Reading the resultant data in the order of ①, ②, ③, ④, . . . can generate the same musical tone as described above.

With this arrangement, it is possible to reproduce a musical tone containing a tone signal with a unique attack portion even if the tone wave data of the attack portion of the musical tone is not separately provided and also reduce the required capacity of the wave memory. In addition, the transition from the cross-fade-mixed portion to the repetitive portion is smooth.

Figure 7:
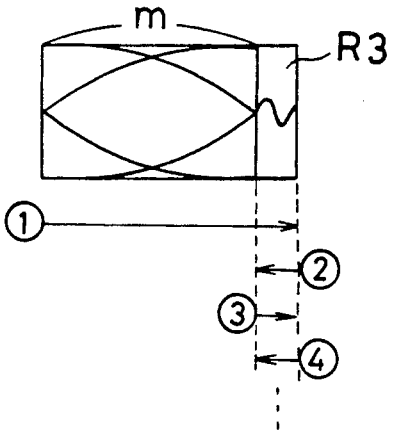
FIG. 7 is a diagram showing a further embodiment of tone wave data as used in the tone generating apparatus of the present invention.

FIG. 7 illustrates another tone wave data produced by combining the features of those tone wave data shown in FIGS. 5 and 6. More specifically, this tone wave data is produced by linking the cross-fade-mixed portion (mix data) generated by the method illustrated in FIG. 6 to a half-period or one-period waveform R3. Then, reading the resultant data in the order of ①, ②, ③, ④, etc., can generate the same musical tone as described above.

With this arrangement, it is possible to provide tone wave data with more compression than the compression shown in FIG. 5 or 6 while reproducing a musical tone containing a tone signal with a unique attack portion, so that the required capacity of the wave memory can further be reduced. In addition, the transition from the cross-fade-mixed portion to the repetitive portion is smooth.

Other types of tone wave data to be stored in the wave memory may of course be prepared by linking various types of wave data through the cross-fade mixing.

An example of the method of producing and reading wave data used in conventional tone generating apparatus will now be discussed to clarify the differences between them and the methods employed in this embodiment.

Figure 8:
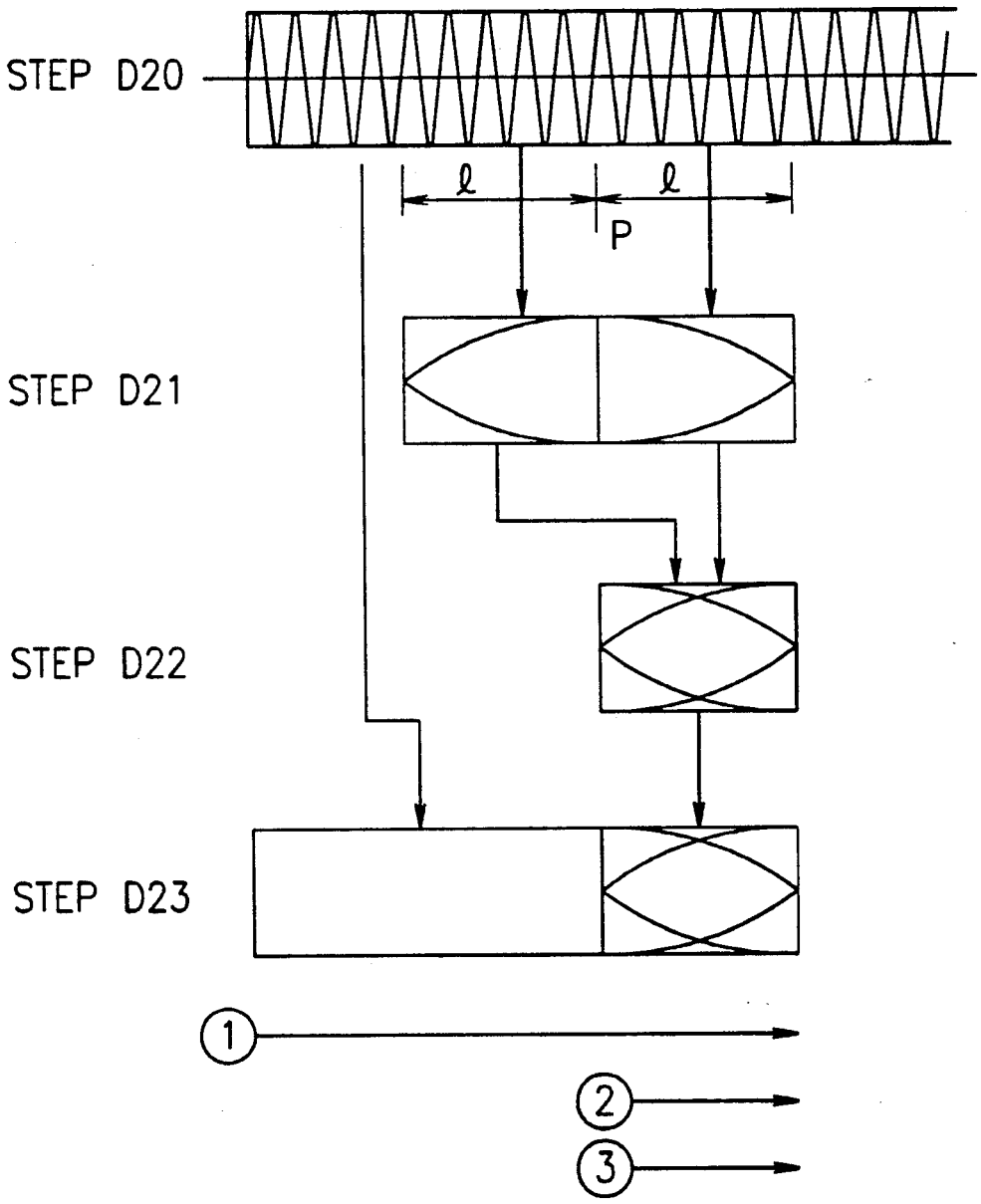
Fig. 8 PRIOR ART
FIG. 8 is a diagram for explaining conventional procedures to produce tone wave data.

In the conventional tone generating apparatus, tone wave data to be stored in the wave memory may be produced through the procedures shown in FIG. 8.

First, PCM wave data which is to be original wave data (original data) is subjected to A/D conversion to provide digital data (step D20). In the case involving a tone signal of a diminishing tone such as a piano sound, the envelope is normalized to convert the signal into tone signal data with a given amplitude.

Then, two pieces of data with a data length of l words are consecutively extracted from the original data, the first l words subjected to fade-in processing and the second l words subjected to fade-out processing (step D21).

Next, the wave data having undergone the fade-in processing and the one having undergone the fade-out processing are cross-fade-mixed by performing an arithmetic operation thereon, and the cross-fade-mixed data serves as loop data (step D22).

Then, data extending from the head of the original data to the center P of the extracted pieces of data is linked with the loop data to acquire a group of tone wave data for a certain timbre (step D23).

The tone wave data group thus produced is stored in a wave memory.

To generate a musical tone using the tone wave data thus produced and stored in the wave memory, first, the tone wave data is read out once from the head to the last portion to release the associated musical tone, as indicated by ①. Thereafter, only the loop data portion will repeatedly be read out to release the associated musical tone, as indicated by ②, ③, . . .

With the above arrangement, the tone generating apparatus can reproduce, with high fidelity, a complex and delicate sound included in the attack portion of a musical tone and can generate a musical tone of the sustaining portion with fewer pieces of tone wave data, thus ensuring data compression. Further, the execution of cross-fade mixing smooths where the attack portion of the musical tone and the repetitive-reading portion are linked, and smooths the link between the consecutive repetitive-reading portions as well.

However, the data of the attack portion of a musical tone consisting of a group of tone wave data prepared by the above method should at least amount to l words (equal to the length of loop data) or greater. Preparation of tone wave data groups in accordance with various timbres, tone ranges, etc., however, would result in a vast amount of data.

In addition, it is necessary to provide a certain amount of tone wave data of the repetitive-reading portion (loop data}to avoid a cyclic uncomfortable sound which may result from an insufficient amount of tone wave data. Certain involved interpolation techniques may be employed during the read-out to help reduce such uncomfortable sound; see for example, U.S. Pat. Nos. 4,635,520 to Mitsumi and 4,916,996 to Suzuki et. al.

By way of contrast, according to the tone generating apparatus of this embodiment, it is possible to arbitrarily set the amount of data of the attack portion of a musical tone. It is also possible to set the amount of data of the attack portion of a musical tone to be zero as shown in FIGS. 6 and 7. The repetitive-reading portion need not be tone wave data of a multiple-period waveform, but may be tone wave data of a single-period or half-period waveform, as shown in FIGS. 5 and 7.

The tone generating apparatus according to this embodiment, therefore, has an effect of further reducing the amount of tone wave data to be stored in the wave memory in addition to the merits of the above-described conventional tone generating apparatus.

Although the foregoing description of this embodiment has been given with reference to the case where head data, mix data and loop data respectively consist of predetermined amounts of data, h, m and l, these data quantities are arbitrary and may be set to the optimal values in accordance with, for example, the timbre designated by a tablet or the tone rage. This feature can allow for the use of a wave memory with the minimum capacity.

Further, according to the embodiment, data is directly cut out from the original data to be data of the attack portion of a musical tone, produce data of the repetitive-reading portion, or produce data of the cross-fade-mixed portion. It is however preferable that the fetched original data is sampled to provide new original data before preparing the tone wave data. This is because the fetched data may have a fluctuating pitch, so that its direct use to generate tone wave data is likely to yield an off-tuned musical tone. In this respect, a better tuned musical tone can be acquired if the tuning pitch is adjusted by the resampling procedure.

As described above, this invention can reduce the required capacity of a wave memory, thus providing a low-cost tone generating apparatus.

It also eliminates the need for costly interpolation circuits that are needed by earlier devices to provide smooth linkage between data groups as they are read out.

This invention is clearly new and useful. Moreover, it was not obvious to those of ordinary skill in this art at the time it was made, in view of the prior art considered as a whole as required by law.

This invention pioneers the art of waveform processing that smoothly links together head, mix, and loop data prior to storage thereof in a wave memory to thereby eliminate the need for interpolation at the time of read-out. Accordingly, the claims that follow are entitled to broad interpretation, as a matter of law, to protect from piracy the heart or essence of this breakthrough invention.

It will thus be seen that the object set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A method for processing a waveform, comprising the steps of:

storing tone wave data in a wave memory;

extracting a predetermined length of head data from an attack portion of an original musical tone;

acquiring loop data by extracting a predetermined length of a sustaining portion of an original musical tone;

subjecting said extracted loop data to predetermined processing;

acquiring a predetermined length of mix data, said predetermined length of mix data including individual waveform elements of said head data and said loop data;

linking said head data and said loop data;

providing reading means for reading out said tone wave data from said wave memory in a predetermined order;

said predetermined order being said head data, said mix data, and said loop data, said loop data being read out repeatedly; and tone generating means for generating a musical tone based on the tone wave data read out by said reading means.

2. The method of claim 1, wherein said step of subjecting said extracted loop data to predetermined processing includes the steps of cross-fade-mixing data to a predetermined interval of said original musical tone, converting said cross-fade-mixed data into point-symmetrical data, and extracting a predetermined half of said point-symmetrical data.

3. The method of claim 1, further comprising the step of using loop wave data in the form of multiple-period tone wave data.

4. The method of claim 1, further comprising the step of using loop wave data in the form of single-period tone wave data.

5. The method of claim 1, further comprising the step of using loop wave data in the form of half-period tone wave data.

6. The method of claim 1, further comprising the step of preparing said mix data of said tone wave data by cross-fade-mixing a predetermined length of an end portion of said head data with a top portion of said loop data having the same predetermined length as said end portion.

7. The method of claim 1, further comprising the step of including mix data and loop data in said tone wave data stored in said wave memory.

8. The method of claim 7, further comprising the step of using loop wave data in the form of multiple-period tone wave data.

9. The method of claim 7, further comprising the step of using loop wave data in the form of single-period tone wave data.

10. The method of claim 7, further comprising the step of using loop wave data in the form of half-period tone wave data.

11. The method of claim 1, further comprising the step of reading said loop data in alternate increasing and decreasing orders.

12. The method of claim 7, further comprising the step of reading said loop data in alternate increasing and decreasing orders.

13. A method for processing a waveform in a tone wave generator of a musical instrument, comprising the steps of:

(a) converting original wave data to digital form;

(b) dividing said original wave data into first, second, and third intervals;

(c) said first interval being head data and having a predetermined length of "h" words;

(d) said second interval being mix data and having a predetermined length of "m" words;

(e) said third interval being loop data and having a predetermined length of "l" words;

(f) selecting a loop point at any preselected location in said original wave data;

(g) extracting a length of data having a length equal to two "l" words of even length from said original wave data from both sides of said loop point to obtain a first even word of "l" length and a second even word of "l" length;

(h) cross-fade mixing said first and second words to produce cross-fade mixed data;

(i) adding a length of data having a data length of one word to the end of the cross-fade mixed data so that said cross-fade mixed data then contains an odd number of words, said added length of data being the first one word of said cross-fade mixed data, said cross-fade mixed data now having an odd number of words;

(j) inverting the phase of said odd-numbered cross-fade mixed data to produce reversed cross-fade mixed data;

(k) adding together said odd-numbered cross-fade data and said reversed cross-fade mixed data to produce point-symmetrical wave data;

(l) said point-symmetrical wave data having a first one word "T," a last one word "E," and a central one word "P," and each of said one words "T," "P," and "E" having a value of zero so that said point-symmetrical wave data exhibits bilateral symmetry about word "P";

(m) extracting said second interval having a length of "m" words from said original wave data;

(n) extracting said second interval from said point-symmetrical wave data, exclusive of said last one word "E" thereof, to produce extracted data having a length of "m" words;

(o) adding said extracted data having a length of "m" words to the beginning of said point-symmetrical wave data to produce a length of data that is continuous with said point-symmetrical wave data;

(p) cross-fade mixing the extracted second interval of step (m) and the extracted data having a length of "m" words of step (n) to smooth the transition between the data obtained by the cross-fade mixing of this step (p) and the point-symmetrical wave data of step (k);

(q) deleting that portion of the point-symmetrical wave data that follows word "P";

(r) extracting from said original wave data said first interval having a length of "h" words;

(s) adding said extracted first interval of step (r) to the beginning of the data obtained in step (q);

(t) reading the data obtained in step (s) one time from beginning to end; and (u) reading the data from word "T" to word "P";

(v) reading the date from word "P" to word "T"; and (w) repeating steps (u) and (v) for a period of time determined by an operator of said musical instrument.

14. The method of claim 13, further comprising the step of weighting the first word of step (g) to have a fade-in effect and weighting the second word of step (g) to have a fade-out effect.

* * * * *